US009121193B2

(12) United States Patent
Hayter et al.

(10) Patent No.: US 9,121,193 B2
(45) Date of Patent: Sep. 1, 2015

(54) FENCING ORNAMENT

(75) Inventors: Darren Hayter, Trigg (AU); Edward Joseph Khoury, Bateman (AU)

(73) Assignee: U-Clik Barriers Pty Ltd, Trigg (AU)

( * ) Notice: Subject to any disclaimer, the term of this patent is extended or adjusted under 35 U.S.C. 154(b) by 143 days.

(21) Appl. No.: 13/993,309

(22) PCT Filed: Dec. 20, 2011

(86) PCT No.: PCT/AU2011/001644

§ 371 (c)(1),
(2), (4) Date: Jun. 11, 2013

(87) PCT Pub. No.: WO2012/083355

PCT Pub. Date: Jun. 28, 2012

(65) Prior Publication Data

US 2013/0273307 A1 Oct. 17, 2013

(30) Foreign Application Priority Data

Dec. 22, 2010 (AU) ..... 2010905620

(51) Int. Cl.

| | |
|---|---|
| ***B32B 3/06*** | (2006.01) |
| ***E04H 17/14*** | (2006.01) |
| ***E04H 17/00*** | (2006.01) |
| *E04F 11/18* | (2006.01) |

(52) U.S. Cl.

CPC ..... *E04H 17/14* (2013.01); *E04F 11/18* (2013.01); *E04H 17/00* (2013.01); *E04H 17/1426* (2013.01); *E04F 2011/1819* (2013.01); *Y10T 428/24008* (2015.01)

(58) Field of Classification Search

CPC ..... E04F 11/1848; E04H 17/00
USPC ..... 428/99; 256/1
See application file for complete search history.

(56) References Cited

U.S. PATENT DOCUMENTS 6,254,064 B1 * 7/2001 Gibbs ..... 256/22

* cited by examiner

*Primary Examiner* — Alexander Thomas
(74) *Attorney, Agent, or Firm* — Tope-McKay & Associates

(57) ABSTRACT

Described is a fencing ornament that is easily installed and removable. A fencing ornament to be secured to a fence structure includes first and second parallel elongate members and a cross member. The fencing ornament comprises a body portion having first, second, third, and fourth side members, and ornamentation within the body portion. Resilient first and second locking members are received in first and second recesses in the third side member adjacent ends thereof. A lug is provided on the fourth side member. Protrusions provided on each of the first and second locking members are moveable by compressing the locking member such that the lug is received in a hole in the cross member and the protrusions are received in a holes in the elongate members.

18 Claims, 8 Drawing Sheets

DETAIL C

SECTION B-B

FENCING ORNAMENT

BACKGROUND OF THE INVENTION (1) Field of Invention

The present invention relates to a fencing ornament and, more particularly, to a fencing ornament that is easily installed and removable.

(2) Description of Related Art

There are many applications in which fencing comprises a plurality of parallel bars. It is also common for such fencing to incorporate various features of ornamentation secured to the bars. Such ornamentation may be permanently attached, such as by welding, or may be fixed with known fasteners.

A continuing need exists for ornamentation that can be applied to such fencing structures in a manner that is easy to install and that may also be removed and replaced, if required.

SUMMARY OF THE INVENTION

The present invention relates to a fencing ornament and, more particularly, to a fencing ornament that is easily installed and removable. The fencing ornament to be secured to a fence structure comprising first and second parallel elongate members and a cross member extending between the first and second elongate members, comprises a body portion having a first side member to be located adjacent the first elongate member, a second side member to be located adjacent the second elongate member, a third side member extending between first ends of the first and second side members, and a fourth side member extending between second ends of the first and second side members, and ornamentation within the body portion. The fence ornament further comprises a resilient first locking member received in a first recess in the third side member adjacent a first side thereof. A resilient second locking member is received in a second recess in the third side member adjacent a second opposite side thereof. A lug is provided on the fourth side member to be inserted into a hole in the cross member by movement towards the cross member such that the fourth side member is thereby secured relative to the cross member. Additionally, a protrusion provided on each of the first and second locking members is moveable by compressing the locking member from a first position in which the protrusion extends outwardly through an aperture in the body portion to a second position in which the protrusion is located within the body portion. The protrusion on the first locking member is receivable in a hole in the first elongate member, and the protrusion on the second locking member is receivable in a hole in the second elongate member.

In another aspect, the third side member comprises an opening having a first internal wall located between a midpoint of the third side member and the first side member and a second internal wall located between the midpoint of the third side member and the second side member, such that the first and second internal walls thereby define the first recess adjacent the first side member, the second recess adjacent the second side member, and a central recess between the first and second internal walls.

In another aspect, each locking member comprises first and second side walls connected by a resilient member, wherein the first protrusion is provided on the first side wall.

In another aspect, the internal walls in the opening of the body portion each also comprise an aperture therein for receiving second protrusions provided on the second side walls of the first and second locking members.

In another aspect, each of the protrusions is cylindrical in shape and extends from opposite sides of the first and second side walls.

In another aspect, a cover member is provided to seal across the opening in the third side member once the fencing ornament is secured in place between the first and second elongate members.

In another aspect, the cover member comprises a flat plate having first and second tabs extending transversely from the plate such that the first tab is located in the central recess adjacent the first internal wall, the second tab is located in the central recess adjacent the second internal wall, and each of the tabs comprises a hole that aligns with the aperture in the adjacent internal wall to receive the second protrusion of the respective locking member to hold the cover member in place.

In another aspect, distal ends of the tabs comprise angled faces such that when the tabs are received in the central recess, the angled faces engage the second protrusions to move the second protrusions back through the apertures in the internal walls, compressing the resilient members.

In another aspect, the lug comprises a protrusion of circular cross section to be received in a circular hole in the cross member.

In another aspect, the resilient member comprises a tubular member.

In another aspect, the tubular member has a quadrilateral cross section.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1C:
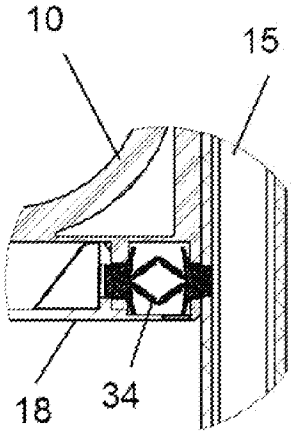
FIG. 1*c* illustrates an enlarged view of Detail C of FIG. 1*b* according to principles of the present invention.

The present invention relates to a fencing ornament and, more particularly, to a fencing ornament that is easily installed and removable. The following description is presented to enable one of ordinary skill in the art to make and use the invention and to incorporate it in the context of particular applications. Various modifications, as well as a variety of uses, in different applications will be readily apparent to those skilled in the art, and the general principles defined herein may be applied to a wide range of embodiments. Thus, the present invention is not intended to be limited to the embodiments presented, but is to be accorded with the widest scope consistent with the principles and novel features disclosed herein.

In the following detailed description, numerous specific details are set forth in order to provide a more thorough understanding, of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter-clockwise have been used for convenience purposes only and are not intended to imply any particular fixed direction. Instead, they are used to reflect relative locations and/or directions between various portions of an object. As such, as the present invention is changed, the above labels may change their orientation.

(I) Specific Details

Referring to the figures, there is shown a fencing ornament 10 for securing to a fence 12. The fence 12 comprises a plurality of elongate members and each of the fencing ornaments 10 are to be secured between an adjacent pair of elongate members. Each fencing ornament 10 is, therefore, secured between a first elongate member 14 and a second elongate member 15.

In the embodiment shown, the fence 12 also comprises an upper cross member 16 and a lower cross member 17. The elongate members extend between the upper and lower cross members 16 and 17, and the fencing ornaments 10 are located, between elongate members adjacent the upper cross member 16.

Each fencing ornament 10 comprises a body portion 18 to be received between the first and second elongate members 14 and 15. The body portion 18 includes ornamentation provided to improve the visual appearance of the fence 12. In the embodiment shown, the body portion 18 comprises a rectangular frame having a first side member 20 to be located adjacent the first elongate member 14, and a second side member 21 to be located adjacent the second elongate member 15. A third side member 22 extends between first ends of the first and second side members 20 and 21 and is located lowermost in use. A fourth side member 23 extends between second ends of the first and second side members 20 and 21 and is located adjacent the upper cross member 16 in use.

Figure 2B:
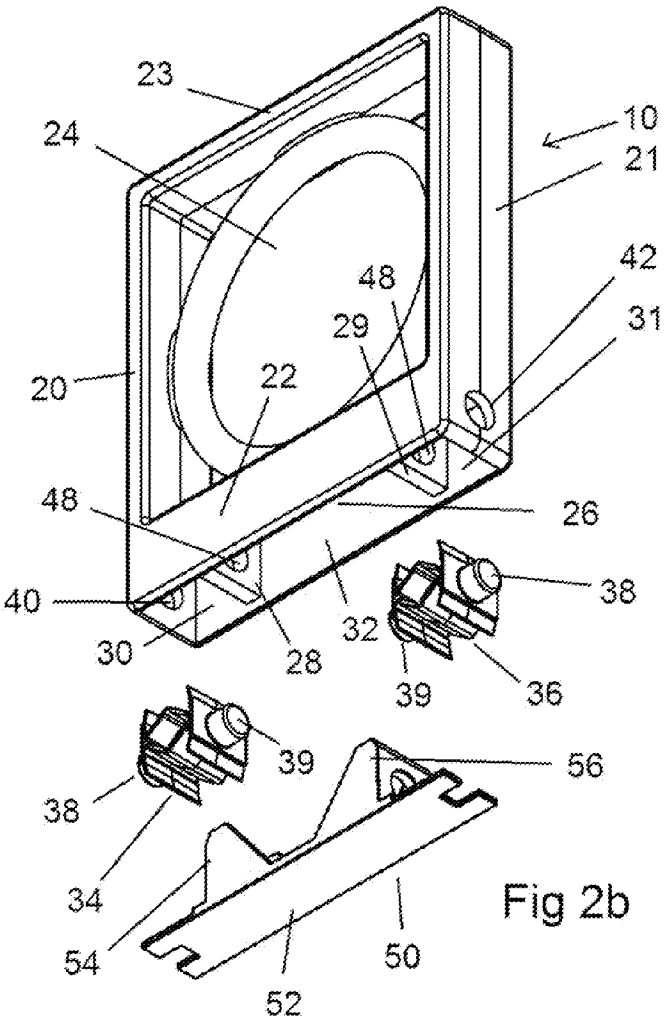
FIG. 2*b* is an exploded-view illustration of one of the fencing ornaments of FIGS. 1*a*-1*c* according to principles of the present invention.
Figure 2A:
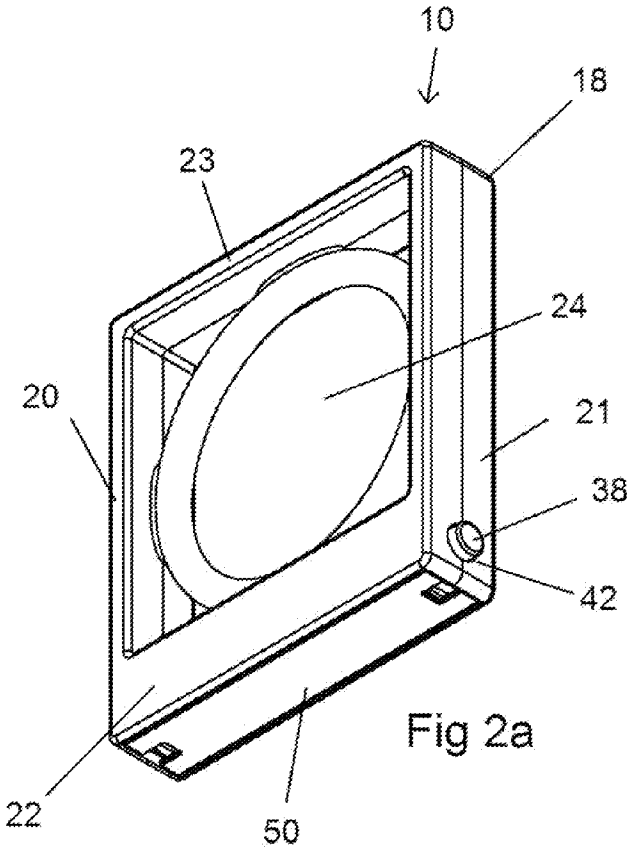
FIG. 2*a* is a bottom, perspective-view illustration of one of the fencing ornaments of FIGS. 1*a*-1*c* according to principles of the present invention.
Figure 3C:
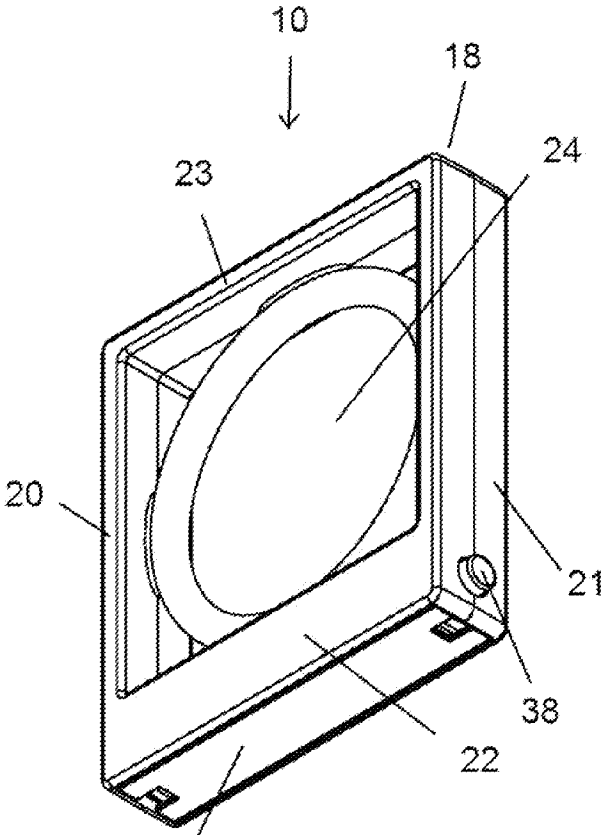
FIG. 3*c* is a bottom, perspective-view illustration of the fencing ornament of FIG. 3*a* according to principles of the present invention.
Figure 3B:
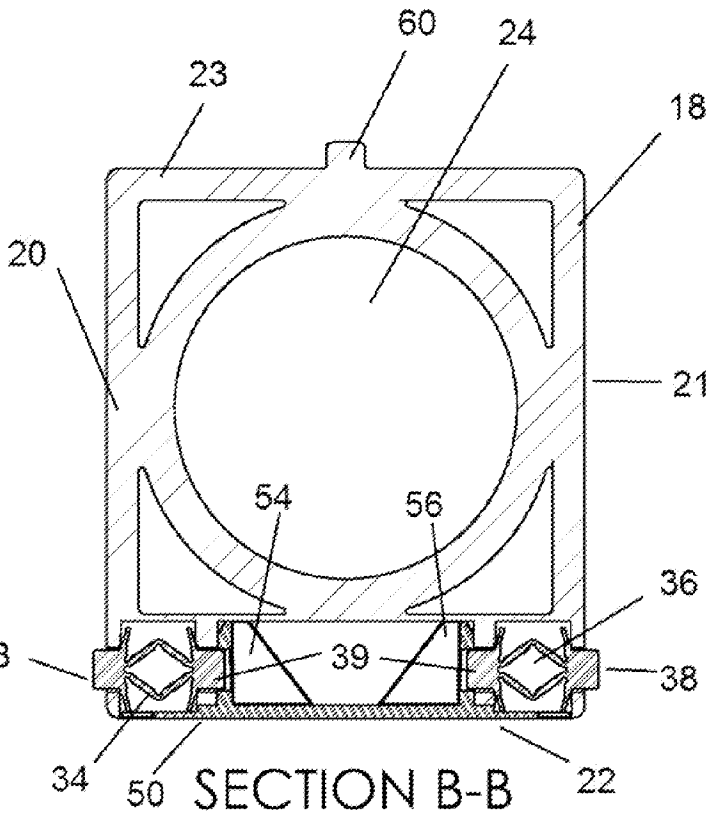
FIG. 3*b* is a front, cross-sectional view illustration of the fencing ornament of FIG. 3*a* through the line B-B according to principles of the present invention.
Figure 3A:
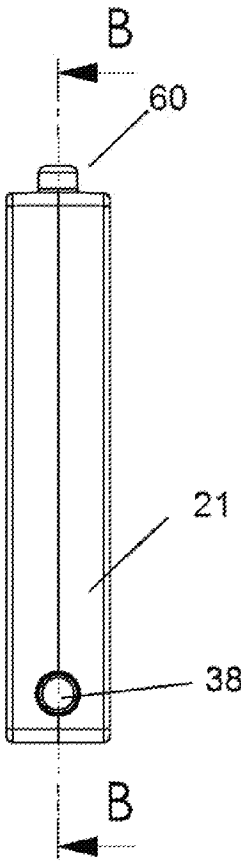
FIG. 3*a* is a side-view illustration of one of the fencing ornaments of FIGS. 1*a*-1*c* according to principles of the present invention.
Figure 4E:
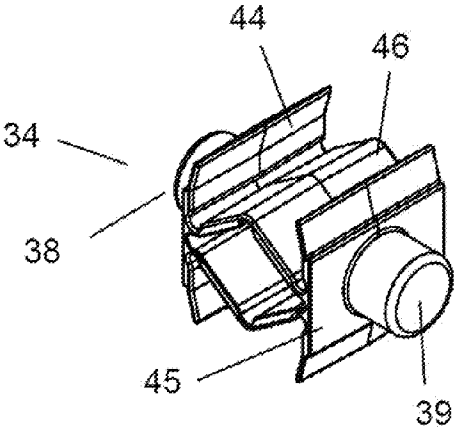
FIG. 4*e* is a top, perspective-view illustration of the locking member according to principles of the present invention.
Figure 4D:
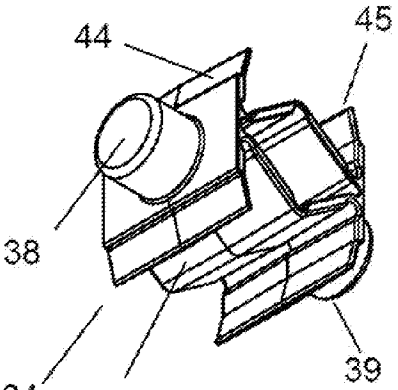
FIG. 4*d* is a bottom, perspective-view illustration of the locking member according to principles of the present invention.
Figure 4C:
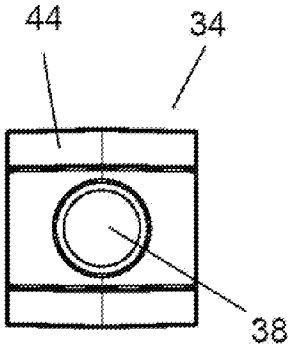
FIG. 4*c* is an end-view illustration of the locking member according to principles of the present invention.
Figure 4A:
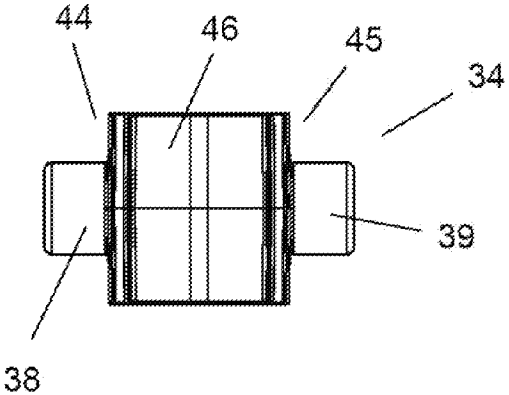
FIG. 4*a* is a top-view illustration of the locking member of the fencing ornament according to principles of the present invention.
Figure 4B:
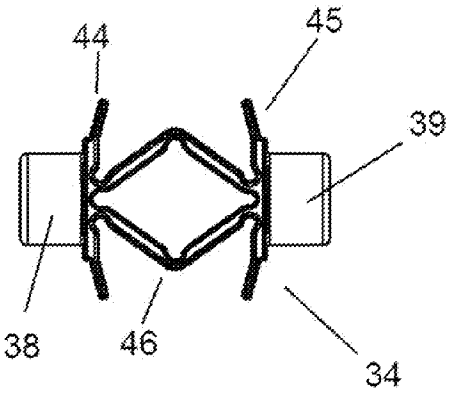
FIG. 4*b* is a front-view illustration of the locking member according to principles of the present invention.
Figure 5E:
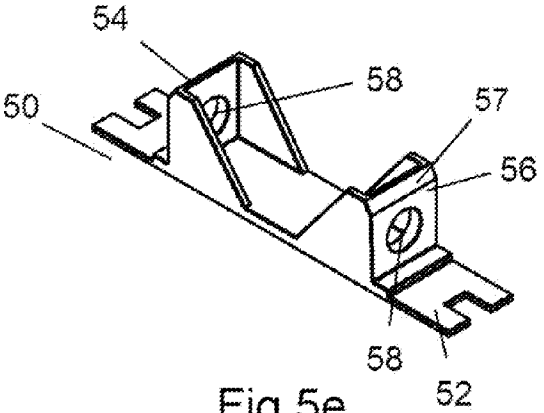
FIG. 5*e* is a top, perspective-view illustration of the cover member according to principles of the present invention.
Figure 5F:
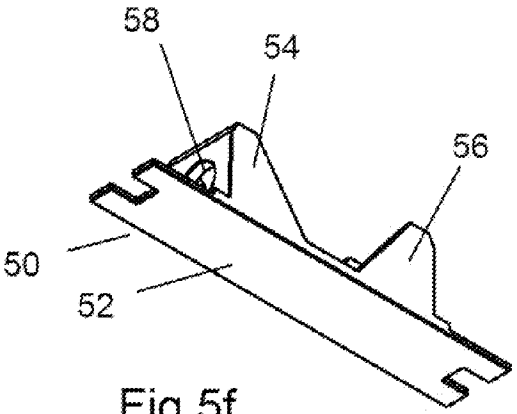
FIG. 5*f* is a bottom, perspective-view illustration of the cover member according to principles of the present invention.
Figure 5D:
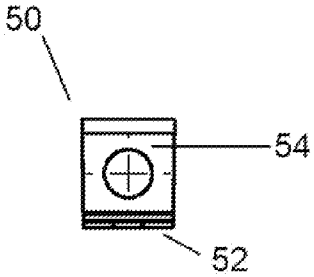
FIG. 5*d* is an end-view illustration of the cover member according to principles of the present invention.
Figure 5A:
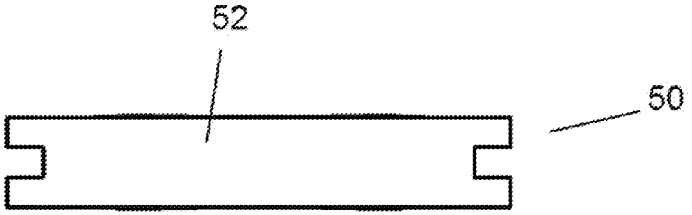
FIG. 5*a* is a bottom-view illustration of a cover member of the fencing ornament according to principles of the present invention.
Figure 5B:
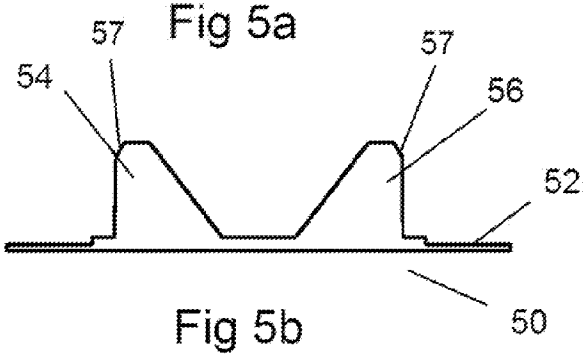
FIG. 5*b* is a front-view illustration of the cover member according to principles of the present invention.
Figure 5C:
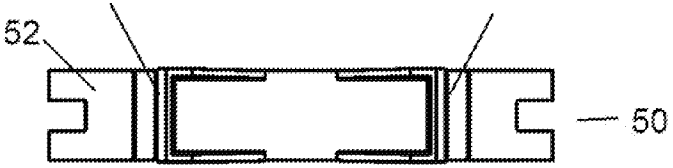
FIG. 5*c* is a top-view illustration of the cover member according to principles of the present invention.

The rectangular frame defines an opening 24 into which is provided the ornamentation. In the embodiment illustrated in FIGS. 1 to 3, the ornamentation comprises a circular ornament fixed within the opening 24.

The third side member 22 of the body portion 18 includes an opening 26 on a side opposite the fourth side member 23. The opening 26 includes a first internal wall 28 located between a midpoint of the third side member 22 and the first side member 20, and a second internal wall 29 located between the midpoint of the third side member 22 and the second side member 21. The first and second internal walls 28 and 29, thereby, define a first recess 30 adjacent the first side member 20, a second recess 31 adjacent the second side member 21, and a central recess 32 located between the first and second internal walls 28 and 29.

The fencing ornament 10 is provided with a first locking member 34 to be received in the first recess 30 and a second locking member 36 to be received in the second recess 31. The first locking member 34 is provided to secure the fencing ornament 10 to the first elongate member 14, and the second locking member 36 is provided to secure the fencing ornament 10 to the second elongate member 15.

The first locking member 34 includes a first protrusion 38 thereon that is oriented such that the first protrusion 38 extends through a first aperture 40 in the first side member 20. The first locking member 34 is compressible such that pushing on the first protrusion 38 compresses the first locking member 34 so that the first protrusion moves from a position in which it extends through the first aperture 40 to a position in which it is located within the body portion 18.

The second locking member 36 includes also a first protrusion 38 thereon that is oriented such that the first protrusion 38 extends through a second aperture 42 in the second side member 21. The second locking member 36 is compressible such that pushing on the first protrusion 38 compresses the second locking member 36 so that the first protrusion 38 moves from an extended position in which it extends through the second aperture 42 to a retracted position in which it is located within the body portion 18.

Each of the first and second elongate members 14 and 15 is provided with a hole on a side facing the fencing ornament 10. The fencing ornament 10 can, therefore, be secured between the first and second elongate members 14 and 15 by depressing the first protrusions 38 to move the first protrusions 38 within the body portion 18. The fencing ornament 10 can then be placed between the first and second elongate members 14 and 15 and the first protrusions 38 released. The first and second locking members 34 and 36 are resilient such that the first protrusions 38 return to the extended position and engage into the holes in the first and second elongate members 14 and 15. The fencing ornament 10 is, thereby, secured between the first and second elongate members 14 and 15, as shown in FIGS. 1*a*-1*e*.

The body portion 12 of the embodiment shown also includes a lug 60 on the fourth side member 23. The lug 60 is provided to be inserted into a corresponding shaped hole provided in the upper cross member 16. The lug 60 comprises a protrusion extending outwardly from the fourth side member 23 such that the lug 60 may be inserted into the hole in the cross member 16 by moving the body portion 12 towards the cross member 16. In the embodiment shown, the lug 60 comprises a protrusion of circular cross section to be received in a circular hole in the cross member 16.

Each of the first and second locking members 34 and 36 is identical. The first protrusion 38 is provided on a first side wall 44, and a second protrusion 39 is provided on a second side wall 45. Each of the protrusions 38 and 39 is cylindrical in shape and extends from opposite sides of the first and second side walls 44 and 45. The second side wall 45 is separated from the first side wall 44 by a resilient member 46 such that the first and second side walls 44 and 45 can be compressed together and then move away from each other when released. The compressible member 46 in the embodiment shown comprises a tubular member with quadrilateral cross section.

The internal walls 28 and 29 in the opening 26 each also include an aperture 48 therein. Each locking member 34 and 36 is received in the respective recess 30 and 31 by compressing the resilient member 46 to move the first and second protrusions 38 and 39 towards each other. When released, the second protrusions 39 move into the apertures 48 in the internal walls 28 and 29 to locate the locking members 34 and 36.

The fencing ornament 10 is provided with a cover member 50. The cover member 50 is provided to seal across the opening 26 once the fencing ornament 10 is secured in place between the first and second elongate members 14 and 15. The cover member 50 comprises a flat plate 52 of the same shape as the opening 26. First and second tabs 54 and 56 extend transversely from the plate 52 such that the first tab 54 is located in the central recess 32 adjacent the first internal wall 28 when the cover member 50 is in place across the opening 26 and the second tab 56 is located in the central recess 32 adjacent the second internal wall 29.

Each of the tabs 54 and 56 includes a hole 58 therein that aligns with the aperture 48 in the internal wall 28 or 29. Distal ends of the tabs 54 and 56 include angles faces 57 such that when the tabs 54 and 56 are received in the central recess 32, the angled faces engage the second protrusions 39 to move the second protrusions 39 back through the apertures 48 in the internal walls 28 and 29, compressing the resilient members 46. Once the holes 58 in the tabs 54 and 56 align with the apertures 48 in the internal walls 28 and 29, the second protrusions 39 of the locking members 34 and 36 move back to be received within the holes 58 in the tabs 54 and 56, thereby securing the cover member 50 in place across the opening 26.

Figure 1B:
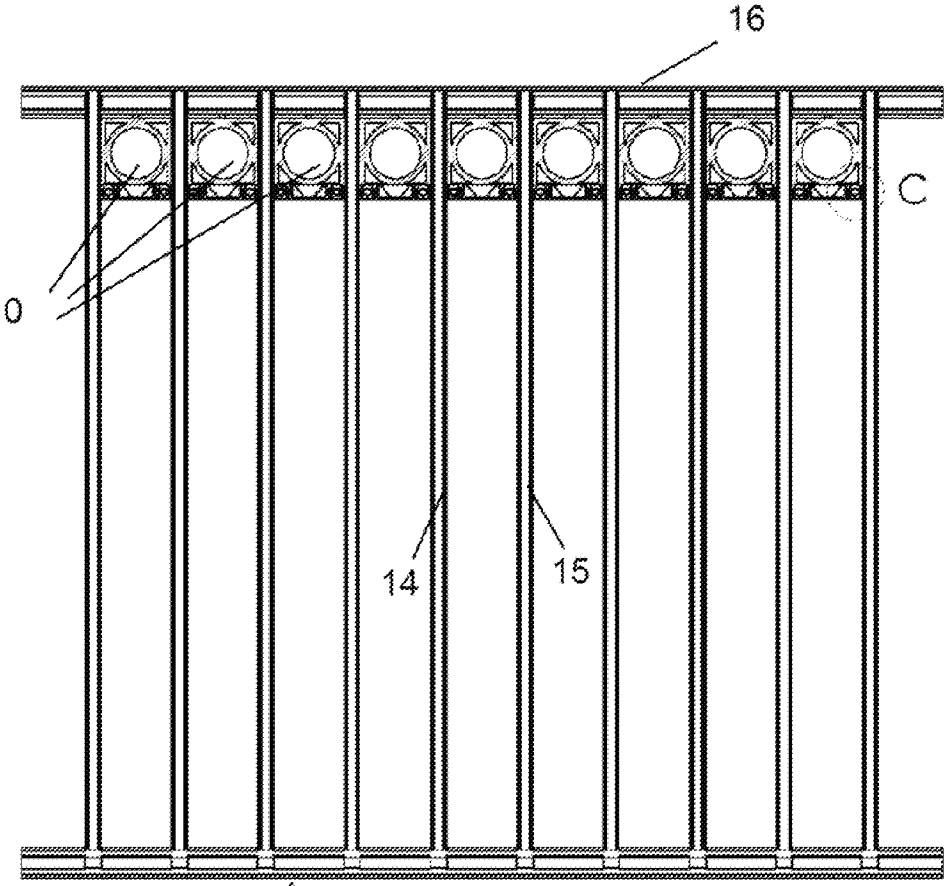
FIG. 1*b* is a front, cross-sectional view illustration of the fence of FIG. 1*a* through the line B-B according to principles of the present invention.
Figure 1A:
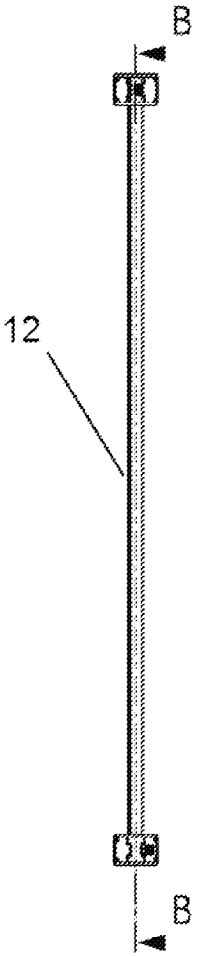
FIG. 1*a* is a side-view illustration of a fence to which fencing ornaments are secured according to principles of the present invention.
Figure 6A:
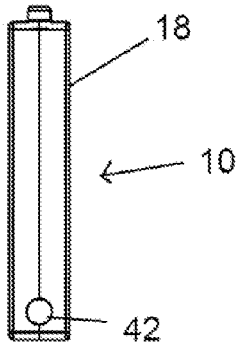
FIG. 6*a* is a side-view illustration of a second embodiment of a fencing ornament according to principles of the present invention.
Figure 6B:
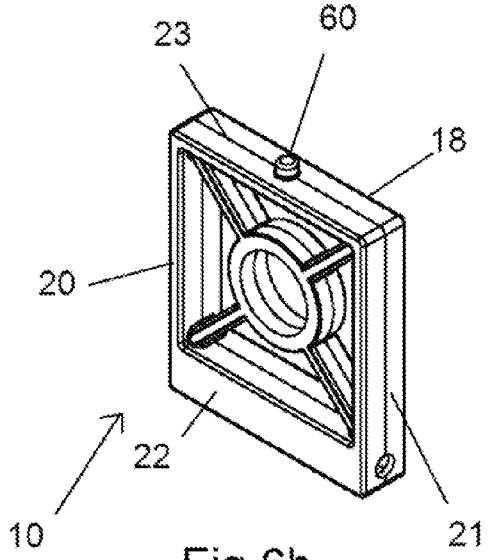
FIG. 6*b* is a top, perspective-view illustration of the fencing ornament of FIG. 6*a* according to principles of the present invention.
Figure 6C:
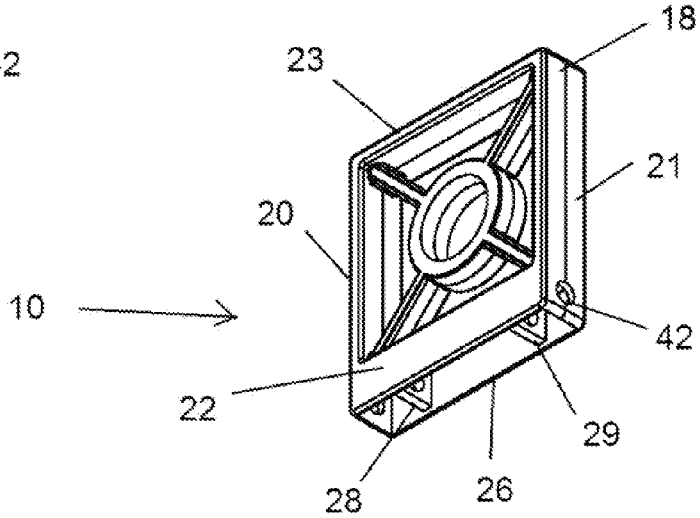
FIG. 6*c* is a bottom perspective-view illustration of the fencing ornament of FIG. 6*a* according to principles of the present invention.
Figure 7A:
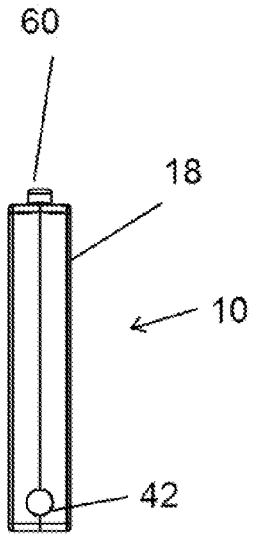
FIG. 7*a* is a top-view illustration of a third embodiment of a fencing main according to principles of the present invention.
Figure 7B:
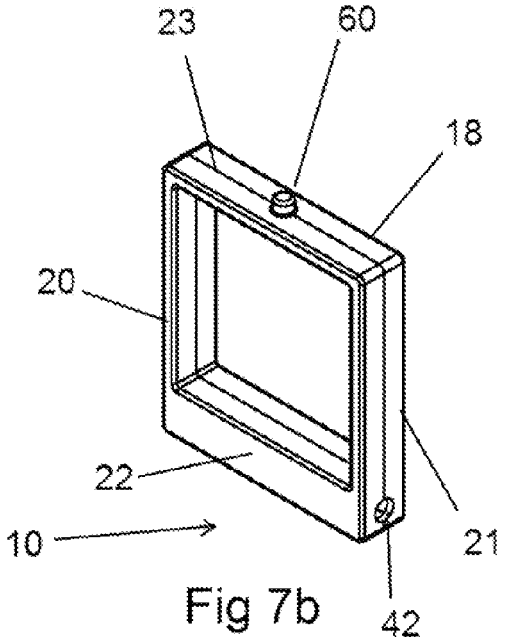
FIG. 7*b* is a front-view illustration of the fencing ornament of FIG. 7*a* according to principles of the present invention.
Figure 7C:
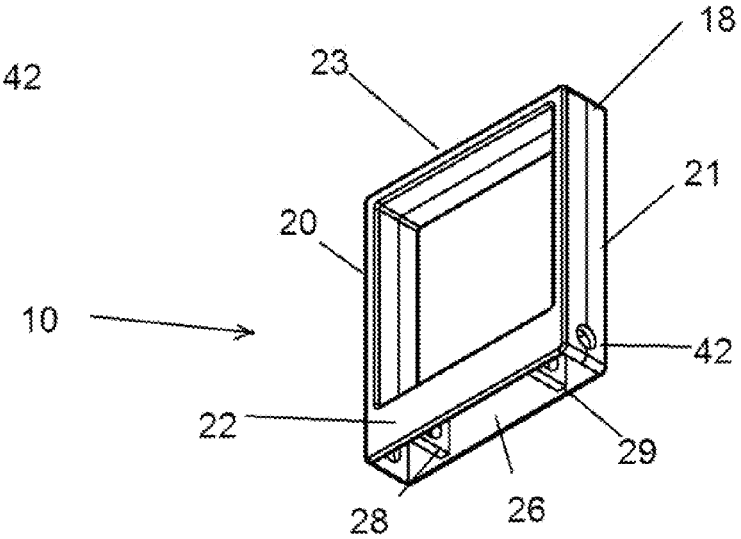
FIG. 7*c* is a bottom-view illustration of the fencing ornament of FIG. 7*a* according to principles of the present invention.
Figure 8A:
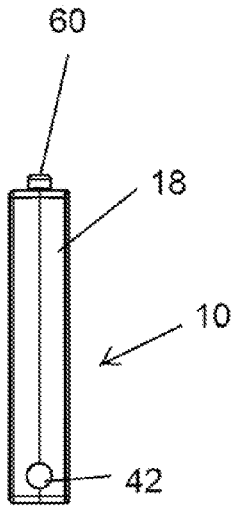
FIG. 8*a* is a top-view illustration of a fourth embodiment of a fencing ornament according to principles of the present invention.
Figure 8B:
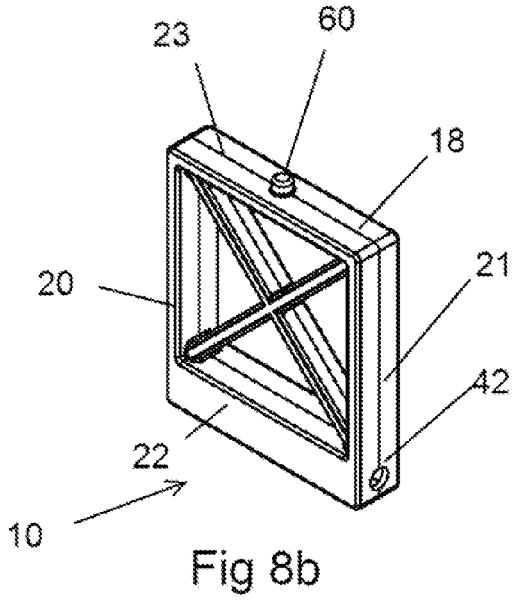
FIG. 8*b* is a front-view illustration of the fencing ornament of FIG. 8*a* according to principles of the present invention.
Figure 8C:
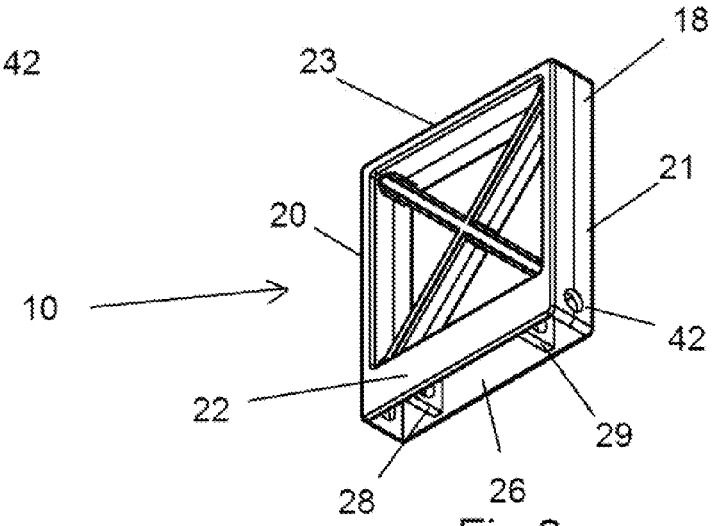
FIG. 8*c* is a bottom-view illustration of the fencing ornament of FIG. 8*a* according to principles of the present invention.

In use, a plurality of fencing ornaments 10 can be secured to the fence 12. Each fencing ornament 10 is located between an adjacent pair of elongate members to create a continuous ornamentation on the fence 12 as shown in FIGS. 1*a*-1*c*. The ornamentation on the fencing ornament 10 can be any desired style. FIGS. 6, 7, and 8 show three different types of ornamentation applied to the fencing ornament 10.

It will be readily apparent to persons skilled in the relevant arts that various modifications and improvements may be made to the foregoing embodiments, in addition to those already described without departing from the bask inventive concepts of the present invention.

What is claimed is:

1. A fencing ornament to be secured to a fence structure comprising first and second parallel elongate members and a cross member extending between the first and second elongate members, the fencing ornament comprising:

a body portion having a first side member to be located adjacent the first elongate member, a second side member to be located adjacent the second elongate member, a third side member extending between first ends of the first and second side members, and a fourth side member extending between second ends of the first and second side members, and ornamentation within the body portion;

a resilient first locking member received in a first recess in the third side member adjacent a first side thereof;

a resilient second locking member received in a second recess in the third side member adjacent a second opposite side thereof;

a lug provided on the fourth side member to be inserted into a hole in the cross member by movement towards the cross member such that the fourth side member is thereby secured relative to the cross member; and a protrusion provided on each of the first and second locking members moveable by compressing the locking member from a first position in which the protrusion extends outwardly through an aperture in the body portion to a second position in which the protrusion is located within the body portion;

wherein the protrusion on the first locking member is receivable in as hole in the first elongate member, and the protrusion on the second locking member is receivable in a hole in the second elongate member.

2. The fencing ornament as set forth in claim 1, wherein the third side member comprises an opening having a first internal all located between a midpoint of the third side member and the first side member and a second internal wall located between the midpoint of the third side member and the second side member, such that the first and second internal walls thereby define the first recess adjacent the first side member, the second recess adjacent the second side member, and a central recess between the first and second internal walls.

3. The fencing ornament as set forth in claim 2, wherein each locking member comprises first and second side walls connected by a resilient member, wherein the first protrusion is provided on the first side wall.

4. The fencing ornament as set forth in claim 3, wherein the resilient member comprises a tubular member.

5. The fencing ornament as set forth in claim 4, wherein the tubular member has a quadrilateral cross section.

6. The fencing ornament as set forth in claim 3, wherein the internal walls in the opening of the body portion each also comprise an aperture therein for receiving second protrusions provided on the second side walls of the first and second locking members.

7. The fencing ornament as set forth in claim 6, wherein the resilient member comprises a tubular member.

8. The fencing ornament as set forth in claim 6, wherein each of the protrusions is cylindrical in shape and extends from opposite sides of the first and second side walls.

9. The fencing ornament as set forth in claim 8, wherein the resilient member comprises a tubular member.

10. The fencing ornament as set forth in claim 8, wherein a cover member is provided to seal across the opening in the third side member once the fencing ornament is secured in place between the first and second elongate members.

11. The fencing ornament as set forth in claim 10, wherein the resilient member comprises a tubular member.

12. The fencing ornament as set forth in claim 10, wherein the cover member comprises a flat plate having first and second tabs extending transversely from the plate such that the first tab is located in the central recess adjacent the first internal wall, the second tab is located in the central recess adjacent the second internal wall, and each of the tabs comprises a hole that aligns with the aperture in the adjacent internal wall to receive the second protrusion of the respective locking member to hold the cover member in place.

13. The fencing ornament as set forth in claim 12, wherein the resilient member comprises a tubular member.

14. The fencing ornament as set forth in claim 12, wherein distal ends of the tabs comprise angled faces such that when the tabs are received in the central recess, the angled faces engage the second protrusions to move the second protrusions back through the apertures in the internal walls, compressing the resilient members.

15. The fencing ornament as set forth in claim 14, wherein the resilient member comprises it tubular member.

16. The fencing ornament as set forth in claim 14, wherein the lug comprises a protrusion of circular cross section to be received in a circular hole in the cross member.

17. The fencing ornament as set forth in claim 1, wherein the lug comprises a protrusion of circular cross section to be received in a circular hole in the cross member.

18. The fencing ornament as set forth in claim 17, wherein the resilient member comprises a tubular member.

* * * * *